US008606470B2

(12) United States Patent
Nicholson et al.

(10) Patent No.: US 8,606,470 B2
(45) Date of Patent: Dec. 10, 2013

(54) LIFT ARM AND IMPLEMENT CONTROL SYSTEM

(75) Inventors: Christian Nicholson, Cary, NC (US); Todd R. Farmer, Dana Point, CA (US)

(73) Assignee: Caterpillar SARL, Geneva (CH)

( * ) Notice: Subject to any disclaimer, the term of this patent is extended or adjusted under 35 U.S.C. 154(b) by 385 days.

(21) Appl. No.: 12/958,998

(22) Filed: Dec. 2, 2010

(65) Prior Publication Data

US 2011/0190942 A1 Aug. 4, 2011

Related U.S. Application Data

(63) Continuation-in-part of application No. 12/642,120, filed on Dec. 18, 2009.

(51) Int. Cl.
*G05D 1/04* (2006.01)

(52) U.S. Cl.
USPC ..... 701/50; 414/685

(58) Field of Classification Search
USPC ..... 701/50; 172/2–4; 37/348, 411–416, 37/347; 180/53.4; 414/685, 686, 696–699; 700/169
See application file for complete search history.

(56) References Cited

U.S. PATENT DOCUMENTS

| | | | | |
|---|---|---|---|---|
| 4,266,909 | A | 5/1981 | Langenfeld | |
| 4,375,344 | A | 3/1983 | Baum et al. | |
| 4,844,685 | A | 7/1989 | Sagaser | |
| 5,188,502 | A | 2/1993 | Tonsor et al. | |
| 5,234,312 | A | 8/1993 | Hirose | |
| 5,924,516 | A | 7/1999 | Sagaser et al. | |
| 6,951,067 | B1 | 10/2005 | Dietz et al. | |
| 7,140,830 | B2 | 11/2006 | Berger et al. | |
| 7,222,444 | B2 * | 5/2007 | Hendron et al. | 37/348 |
| 7,530,185 | B2 | 5/2009 | Trifunovic | |
| 7,778,757 | B2 * | 8/2010 | Brattberg | 701/51 |
| 2004/0136821 | A1 | 7/2004 | Berger et al. | |
| 2009/0162177 | A1 | 6/2009 | Nichols | |

FOREIGN PATENT DOCUMENTS

| | | |
|---|---|---|
| EP | 1988220 | 11/2008 |
| WO | 2007054123 | 5/2007 |

* cited by examiner

*Primary Examiner* — Dalena Tran
(74) *Attorney, Agent, or Firm* — Leydig, Voit & Mayer

(57) ABSTRACT

A system for a loader stores a signal indicative of a desired inclination of an implement. Upon receiving an operator interface actuation signal, a controller transmits a signal to move the implement to the stored inclination. The controller further transmits a lift arm command signal to move a lift arm towards a lower limit of travel of the lift arm. The lift arm command signal is terminated after the controller receives a signal from a sensor on the lift arm indicating that the lift arm is near its lower limit of travel. After the command signal is terminated, the controller may transmit a second lift arm command signal to further move the lift arm.

20 Claims, 4 Drawing Sheets

LIFT ARM AND IMPLEMENT CONTROL SYSTEM

CROSS-REFERENCE TO RELATED APPLICATION

This patent application is a continuation-in-part of copending U.S. patent application Ser. No. 12/642,120, filed Dec. 18, 2009.

TECHNICAL FIELD

This disclosure relates generally to a system for controlling a lift arm and an implement and, more particularly, to a system for automatically returning a lift arm and an implement to a desired location.

BACKGROUND

Machines with various implements are often used in the materials handling and construction industries. These machines typically include one or more lift arms for moving an implement in order to perform a desired task. The machines are often used for repetitive motions of some type such as lifting a load of material and transporting it to another location. The machine may then be returned to the original location and the implement lowered to the starting position in order to begin another material movement cycle. To achieve maximum production, an operator will often simultaneously steer the machine and adjust the position of the implement. The process can be significantly simplified if the implement were able to return to a preselected position without requiring the attention of the operator.

U.S. Pat. No. 7,140,830 to Berger et al. discloses an electronic control system for skid steer loaders. More specifically, the Berger et al. system provides a complex variety of modes, features, and options for controlling implement position, including an automatic "return-to-dig" mode in which the controller operates to move the implement and boom assembly to a fixed, memorized orientation and position relative to the skid steer loader. However, the Berger et al. system relies largely upon multiple position sensors for information about and to control the implement position which adds cost and complexity to the system.

The foregoing background discussion is intended solely to aid the reader. It is not intended to limit the innovations described herein nor to limit or expand the prior art discussed. Thus the foregoing discussion should not be taken to indicate that any particular element of a prior system is unsuitable for use with the innovations described herein, nor is it intended to indicate any element, including solving the motivating problem, to be essential in implementing the innovations described herein. The implementations and application of the innovations described herein are defined by the appended claims.

SUMMARY

In one aspect, a system for a loader is provided. The system operates to store a signal indicative of a desired inclination of an implement. Upon receiving a signal indicative of actuation of an operator interface, a controller transmits an implement command signal to the system to move the implement to the stored inclination. The controller may further transmit a lift arm command signal to the system to move a lift arm towards a lower limit of travel of the lift arm. After the controller receives a signal indicative of activation of a sensor on the lift arm based upon the sensor being near a sensor trigger on the loader near a lower limit of travel of the lift arm, the controller terminates the lift arm command signal and movement of the lift arm may be terminated. If desired, the controller may transmit a second lift arm command signal to the system to further move the lift arm.

DETAILED DESCRIPTION

Figure 1:
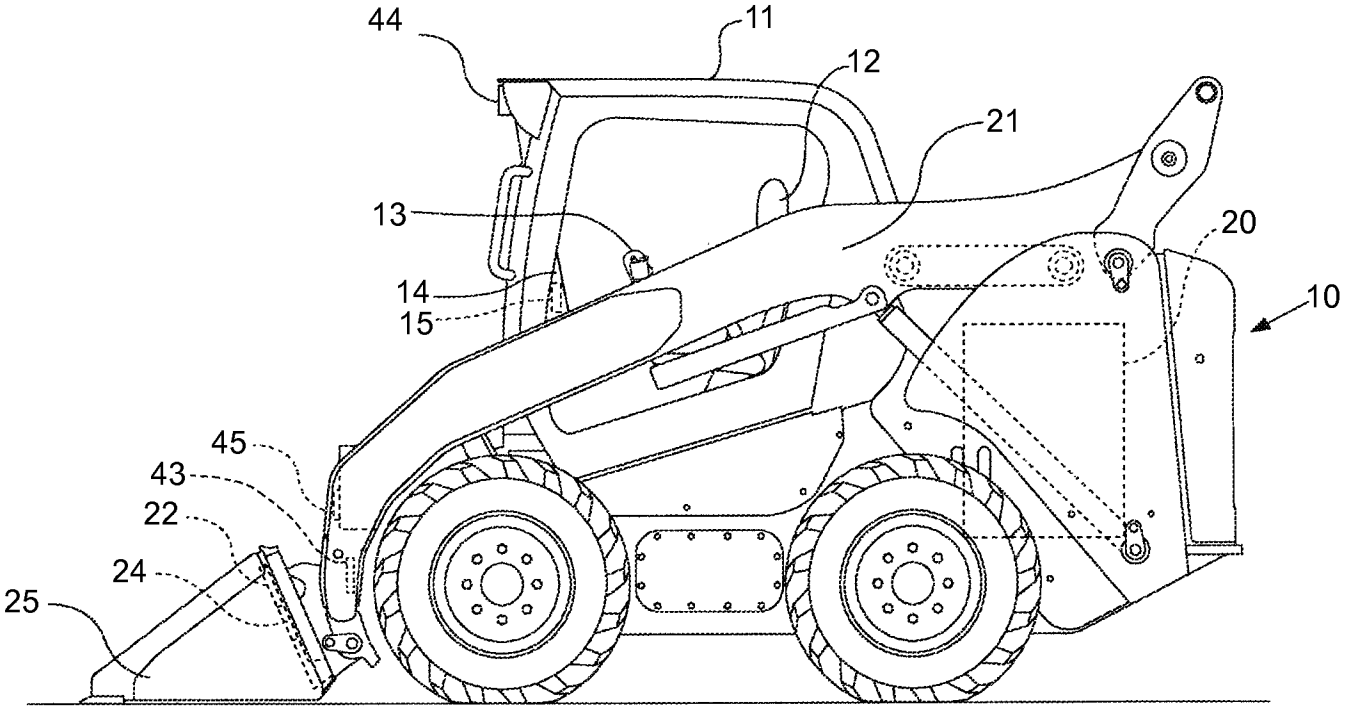
FIG. 1 is an elevational view of a loader in accordance with the disclosure.

FIG. 1 illustrates an exemplary loader 10 having a cab 11 housing an operator seat 12, an operator interface 13, a control panel 14, and a controller 15. The loader 10 further includes an engine system 20, one or more lift arms 21, a lift arm actuation system 46, a coupler 22 mounted on the lift arm 21, a coupler actuation system 23, and an angle sensor 24 mounted on the coupler 22. An implement 25 is attached to the coupler 22. The operator interface 13, the control panel 14, the engine system 20, lift arm actuation system 46, the coupler actuation system 23, and the angle sensor 24 are each configured to communicate with the controller 15. The loader 10 is provided with sufficient electrical and electronic connectivity (not shown) to enable such communication. Though the illustrated loader 10 is a skid steer loader, the loader may be any other type of loader.

The controller 15 may be a single microprocessor or a plurality of microprocessors and could also include additional microchips and components for random access memory, storage, and other functions as necessary to enable the functionalities described herein. The lift arm actuation system 46 is an electro-hydraulic actuation system linking the controller 15 and the lift arm 21 and controlling movement of lift arm 21. The coupler actuation system 23 is an electro-hydraulic actuation system linking the controller 15 and the coupler 22 and controlling movement of coupler 22 and thus also controlling movement of implement 25. The angle sensor 24 of the disclosed embodiment may be an inclinometer that provides an angle of the coupler relative to a ground reference. Other types of angle sensors for measuring the inclination of implement 25 may also be used. Although the illustrated implement 25 is a bucket, the implement may be any other type of implement attachable to the coupler 22.

Figure 2:
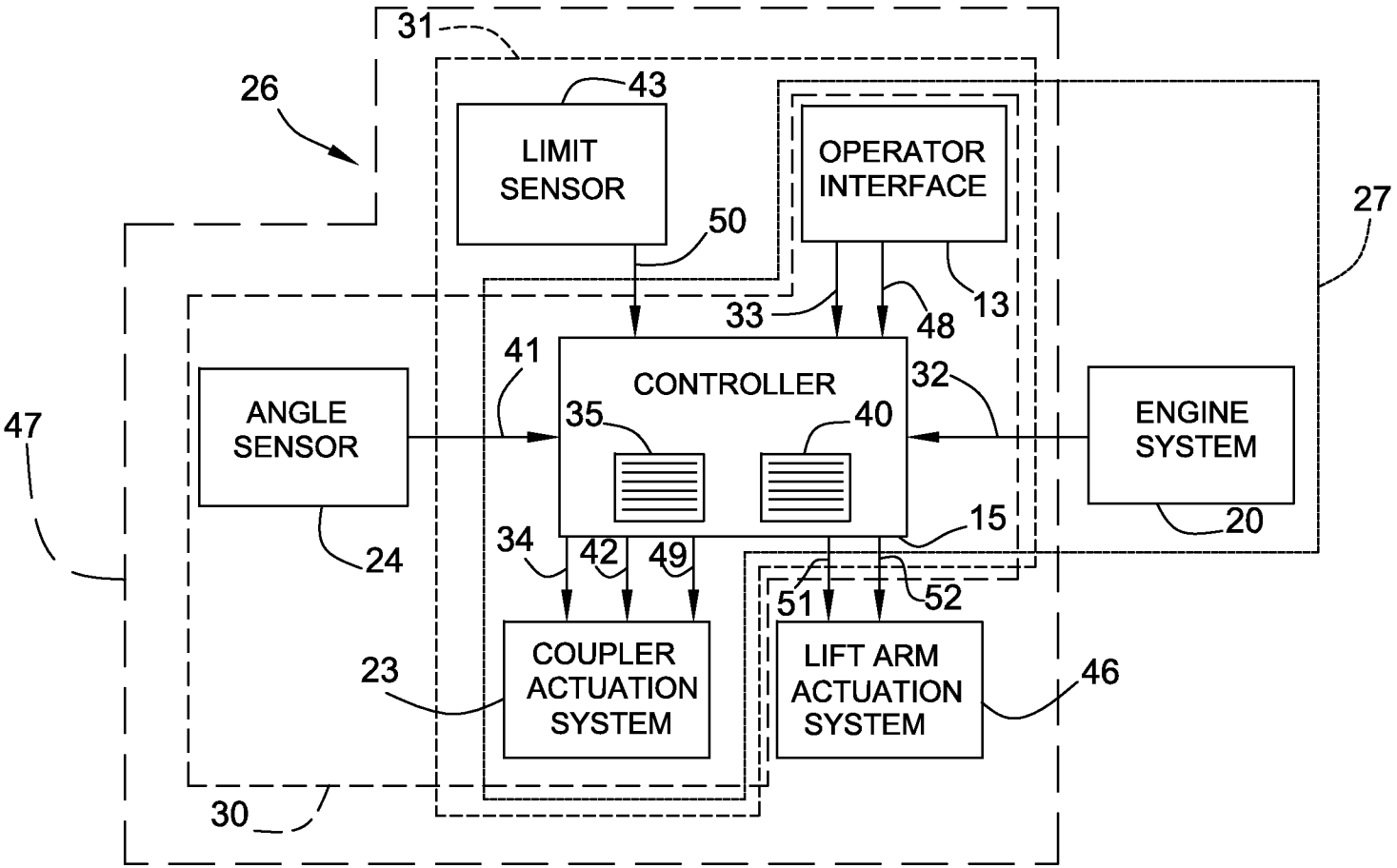
FIG. 2 is a schematic diagram of a system for use with the loader of FIG. 1.

Referring to FIG. 2, a system 26 of loader 10 is depicted for controlling movement of lift arm 21 and an angle of the implement 25. The system 26 includes an open loop subsystem 27, a closed loop subsystem 30, a limit subsystem 31, and a "return-to-dig" subsystem 47. The open loop subsystem 27 includes the operator interface 13, the controller 15, the engine system 20, and the coupler actuation system 23. Specifically, in the open loop subsystem 27, the controller 15 is configured to receive a signal 32 indicative of the speed of the engine in the engine system 20 and a signal 33 indicative of an actuation of the operator interface 13. The operator interface actuation signal 33 is indicative of a command from an operator for the lift arm 21 to move at a speed associated with the degree of operator interface actuation. For instance, the operator interface 13 may be a joystick and commanded lift arm movement speed may vary directly with joystick displacement. Based at least upon the engine speed signal 32 and the operator interface actuation signal 33, the controller 15 calculates a first angle correction signal, also referred to herein as an open loop correction signal 34. The controller 15 then transmits the open loop correction signal 34 to the coupler actuation system 23 to move the coupler 22 which also results in the movement of the implement 25 attached to the coupler 22.

The controller 15 calculates the open loop correction signal 34 by multiplying an initial correction calculation by an engine speed factor. The initial correction calculation is associated with the commanded lift arm movement speed, whereas the engine speed factor is associated with the engine speed indicated by the engine speed signal 32. These associations may be specified in maps, lookup tables, or similar data structures programmed into the controller 15. Specifically, upon receiving the operator interface actuation signal 33 and discerning a commanded lift arm movement speed from the operator interface actuation signal 33, the controller 15 accesses a first map 35 that associates lift arm movement speeds with initial correction calculations and utilizes the first map 35 to determine the initial correction calculation associated with the lift arm movement speed indicated by the operator interface actuation signal 33. In addition, upon receiving the operator interface actuation signal 33, the controller 15 determines the engine speed indicated by the engine speed signal 32, accesses a second map 40 that associates engine speeds with engine speed factors, and utilizes the second map 40 to determine the engine speed factor associated with the engine speed indicated by the engine speed signal 32. Then, as mentioned above, the controller 15 multiplies the initial correction calculation by the engine speed factor to arrive at the open loop correction signal 34 to be transmitted to the coupler actuation system 23.

The closed loop subsystem 30 includes the operator interface 13, the controller 15, the coupler actuation system 23, and the angle sensor 24. Specifically, in the closed loop subsystem 30, the controller 15 receives a coupler angle signal 41 from the angle sensor 24 mounted on the coupler 22 and calculates a second angle correction signal, also referred to herein as a closed loop correction signal 42, based at least upon the coupler angle signal 41. More specifically, when the operator interface actuation signal 33 received by the controller 15 includes a command to start lift arm movement or to change the direction of lift arm movement from up to down or vice versa, the controller 15 stores the coupler angle most recently indicated by the coupler angle signal 41 as a target angle. The controller 15 then monitors the coupler angle signal 41 for deviations from the target angle. Then the controller 15 calculates the difference between the stored target angle and the actual angle continually indicated by the coupler angle signal 41 and, based upon the calculated difference between the angles, transmits the closed loop correction signal 42 to the coupler actuation system 23 such that the coupler 22 is moved to the extent necessary for the actual angle indicated by the coupler angle signal 41 to match the target angle.

The limit subsystem 31 includes the operator interface 13, the controller 15, the coupler actuation system 23, a sensor such as a limit sensor 43 (FIG. 1), and upper and lower sensor triggers 44, 45. The sensor may be any type of presence or proximity sensor, while the sensor triggers 44, 45 may be metal strips or any other elements configured to trigger the limit sensor 43. If desired, the sensor could be a mechanical switch triggered as it moves past trigger structures. The limit sensor 43 is mounted on the lift arm 21 of the loader 10 and the sensor triggers 44, 45 are mounted on the loader 10 such that the limit sensor 43 detects the presence of the sensor triggers 44, 45 as the lift arm approaches its upper and lower limits of the travel, respectively.

In one embodiment, the sensor triggers 44, 45 may be positioned approximately 10-12 inches before reaching the physical upper and lower limits of travel of lift arm 21. More specifically, referring to FIG. 1, lift arm 21 is depicted at its lower limit of travel position. As depicted, limit sensor 43 is not aligned with the lower sensor trigger 45 when lift arm 21 is positioned at its lower limit of travel, but rather positioned slightly below or past the lower sensor trigger. This configuration permits the end of the lift arm 21 to continue to travel approximately 10-12 inches after limit sensor 43 passes lower sensor trigger 45. Similarly, lift arm 21 may continue to travel approximately 10-12 inches above or past upper sensor trigger 44 after limit sensor 43 passes the upper sensor trigger. The exact amount of travel past the sensor triggers may be adjusted as desired by appropriately configuring the controller 15.

When the limit sensor 43 detects the presence of one of the sensor triggers 44, 45, the limit sensor 43 transmits a binary signal or limit signal 50 to the controller 15. The controller 15 is configured to receive the limit signal 50 and, upon receipt of the limit signal, to discontinue transmitting the open and closed loop correction signals 34, 42 to the coupler actuation system 23. Automatic movement of the coupler 22 by the system 26 is thus discontinued adjacent the limits of travel of the lift arm 21, thereby helping to prevent overcorrection of the angle of the coupler 22, and by extension, overcorrection of the angle of the implement 25.

The controller 15 is also configured to calculate a position of the lift arm 21 based at least upon the limit signal 50. The controller 15 calculates the position of the lift arm 21 by referring to the operator interface actuation signal 33 to determine which direction the operator interface actuation signal 33 most recently commanded the lift arm 21 to move. When the controller 15 receives a limit signal 50, if the operator interface actuation signal 33 indicates that the lift arm 21 was most recently commanded to move up, the controller 15 concludes that the limit sensor 43 has sensed the presence of the upper sensor trigger 44 and, by extension, that the lift arm 21 has reached a position near the upper limit of lift arm travel. Similarly, if the operator interface actuation signal indicates that the lift arm 21 was most recently commanded to move down, the controller 15 concludes that the limit sensor 43 has sensed the presence of the lower sensor trigger 45 and, by extension, that the lift arm 21 has reached a position near the lower limit of lift arm travel.

The "return-to-dig" subsystem 47 includes the operator interface 13, the controller 15, the coupler actuation system 23, the angle sensor 24, the limit sensor 43 and the lift arm actuation system 46. System 26 utilizes a "return-to-dig" mode in which the controller 15 operates to return the lift arm 21 to a starting or base position adjacent its lower limit of travel of lift arm 21 and return implement 25 to a stored or memorized orientation. In one example, an operator may perform some type of repetitive work operation with lift arm 21 and implement 25 such as digging material with a bucket. The operator may move the lift arm 21 and implement 25 to a carrying position while moving loader 10 to another location at which the material is removed from the implement (e.g., dumped from a bucket). As the operator returns the loader 10 to the original location to begin the work cycle again, it may be desirable for the operator to simultaneously and automatically move the lift arm 21 and work implement 25 to the base position in order to maximize production. This base position is often referred to as a "return-to-dig" position even though it need not be a position or orientation used for digging. At the base or "return-to-dig" position, lift arm 21 is positioned near its lower limit of travel and implement 25 is positioned at an orientation specified by the operator. Accordingly, the base position includes two components—one specifying the position of the lift arm 21 and one specifying the orientation of implement 25. The desired position of lift arm 21 relative to the lower limit of travel may be set by a configuration within the controller 15 while the desired orientation of the implement may be set by the operator.

Figure 3:
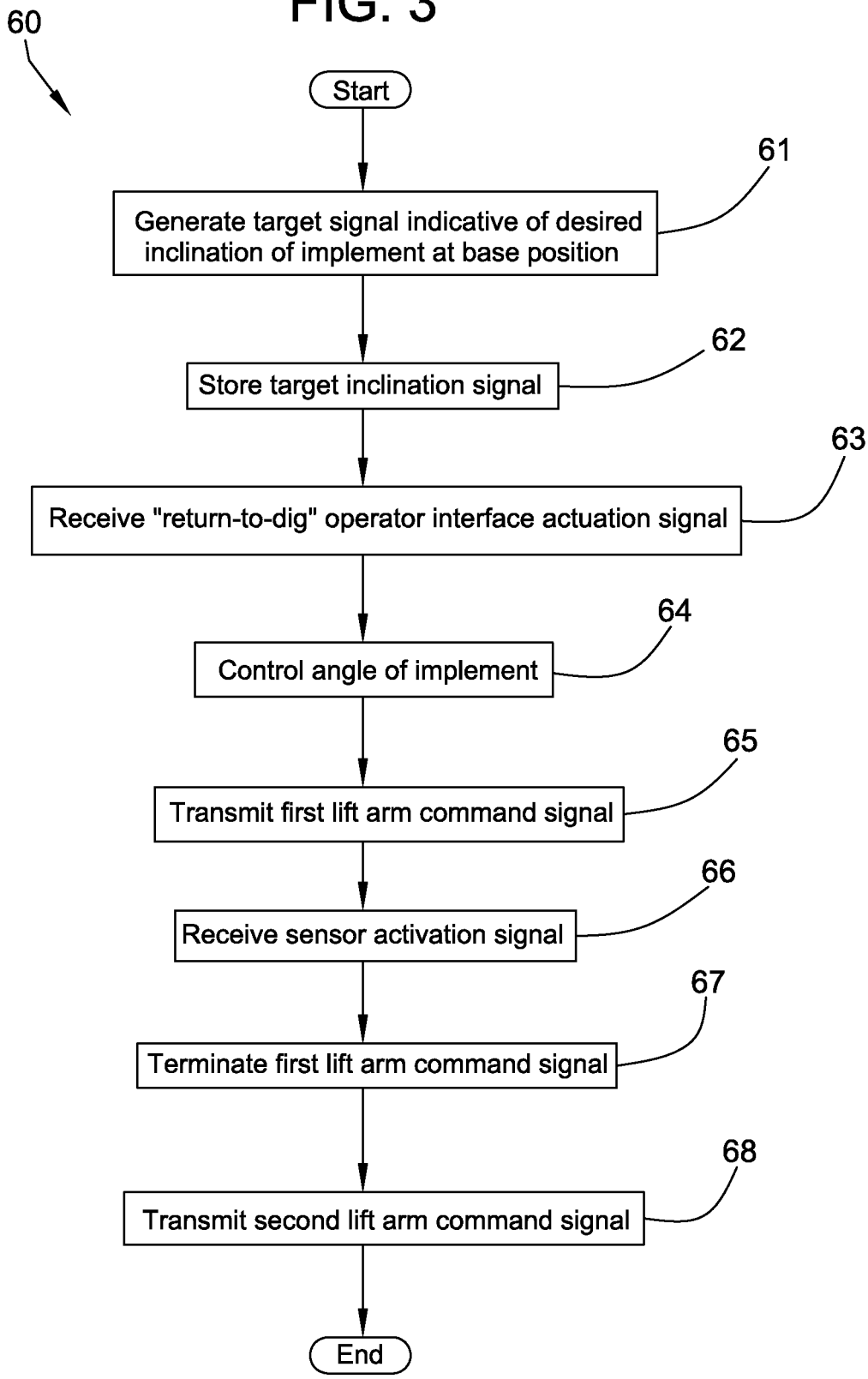
FIG. 3 is a flowchart illustrating a process for controlling automated movement of a lift arm and an implement to a predetermined location.

FIG. 3 is a flowchart 60 depicting the "return-to-dig" process. After the implement 25 is positioned at a desired angular orientation, the operator actuates a component of operator interface 13 such as a switch in order to generate at stage 61 a target signal indicative of the desired inclination of the implement at the base position. Controller 15 then stores the target inclination signal at stage 62.

Once the target inclination signal indicative of the desired inclination of coupler 22, and thus implement 25, has been stored within controller 15, the operator may move lift arm 21, implement 25 and loader 10 as desired in order to perform the operator's desired tasks. The operator may return lift arm 21 and implement 25 to the base position at any time by sending a "return-to-dig" operator interface actuation signal 48 to controller 15 based upon actuation of operator interface 13 such as by pressing a "return-to-dig" switch at stage 63. Upon receiving such a "return-to-dig" operator interface actuation signal 48, controller 15 begins to control the angle of implement 25 at stage 64 by monitoring the coupler angle signal 41 for deviations from the target inclination signal. The controller 15 then calculates the difference between the stored target inclination angle and the actual angle continually indicated by coupler angle signal 41 and, based upon the calculated difference between angles, transmits an implement command signal 49 to coupler actuation system 23 such that coupler 22 is moved to the extent necessary for the actual angle indicated by the coupler angle signal 41 to match the target inclination signal.

In addition, at stage 65, controller 15 transmits a first lift arm command signal 51 to the lift arm actuation system 46 which moves lift arm 21 downward. Since the loader 10 only includes a limit sensor 43 on lift arm 21 and sensor triggers 44 and 45 on loader 10, the exact position of lift arm 21 relative to loader 10 is often not known by controller 15. In other words, controller 15 is able to determine when lift arm 21 is near or above upper sensor trigger 44 but when lift arm 21 is positioned such that limit sensor 43 is between upper sensor trigger 44 and lower sensor trigger 45, controller 15 cannot determine the exact distance of lift arm 21 from the lower sensor trigger 45 or the lower limit of travel due to the simplified sensor system of loader 10. Accordingly, controller 15 provides the first lift arm command signal 51 to lift arm actuation system 46 to propel or move lift arm 21 downward at a predetermined rate until limit sensor 43 on lift arm 21 reaches lower sensor trigger 45.

Moving limit sensor 43 near or adjacent sensor trigger 45 activates the limit sensor 43 at stage 66 changing its status from either off to on or on to off depending on the type of limit switch used and such status change is monitored by controller 15 at stage 66. Based on the status change of limit sensor 43, controller 15 recognizes that lift arm 21 is positioned with limit sensor 43 near lower sensor trigger 45. Controller 15 then terminates the first lift arm command signal 51 at stage 67 in order to terminate the downward movement of lift arm 21. If desired, controller 15 may, at stage 68, transmit a second lift arm command signal 52 to the lift arm actuation system 46 in order to continue the movement of the lift arm downward from a position in which limit sensor 43 is generally aligned with lower sensor trigger 45 to another position closer to its lower limit of travel. This additional downward movement directed by second lift arm command signal 52 may be slower than the downward movement directed by the first lift arm command signal 51. In other words, controller 15 may be configured so that once limit sensor 43 reaches lower sensor trigger 45, it either stops lift arm 21 or supplies a second lift arm command signal 52 to lift arm actuation system 46 to move lift arm 21 further downward towards its lower limit of travel. It may be possible to configure controller 15 such that the second lift arm command signal moves the lift arm 21 upwards away from the lower limit of travel, if desired.

Since, in one embodiment, loader 10 does not include sensors to determine when lift arm 21 has reached its lower limit of travel, controller 15 is configured to estimate the speed and duration of downward movement necessary for lift arm 21 to reach its lower limit of travel and generates the second lift arm command signal 52 based on that estimate. The controller then sends the second lift arm command signal 52 to the lift arm actuation system 46 at stage 68. If desired, controller 15 may be configured such that the second lift arm command signal positions lift arm 21 at a position other than close to the lower limit of travel by changing the calculation of the second lift arm command signal.

Figure 4:
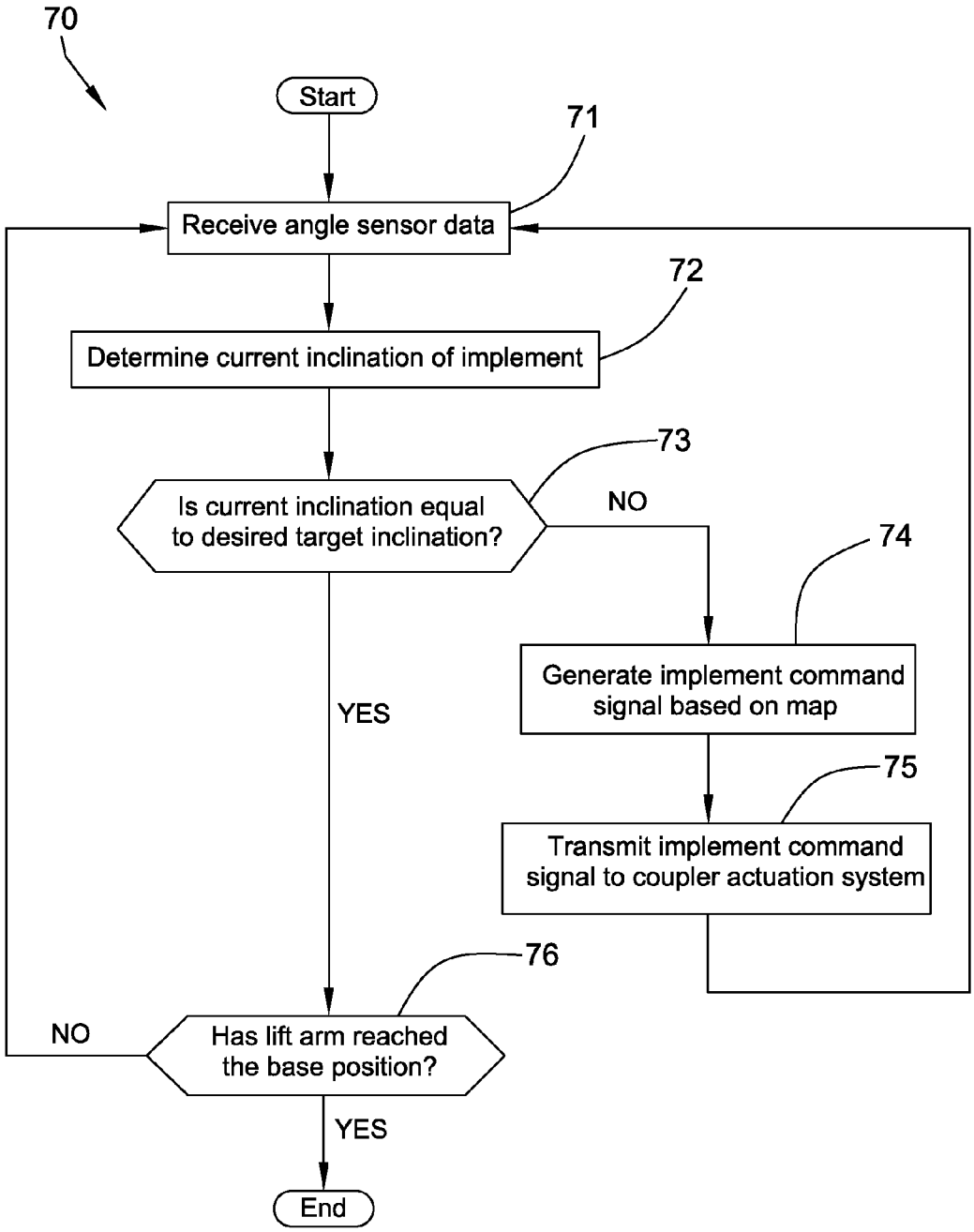
FIG. 4 is a flowchart illustrating a process for controlling automated movement of an implement to a predetermined angle of inclination.

Referring to FIG. 4, flowchart 70 depicts the process by which controller 15 controls the angle of inclination of implement 25. Since lift arm 21 is rotated downward during the "return-to-dig" process and the angle of inclination in the depicted embodiment is measured by an inclinometer that measures the angle of coupler 22 relative to an earth reference, the angle of implement 25 relative to the earth reference will constantly change as lift arm 21 moves. Accordingly, controller 15 is configured to monitor the coupler angle signal 41 from angle sensor 24 and interact with coupler actuation system 23 in order to position implement 25 in the desired inclination once lift arm 21 reaches its lower limit of travel. More specifically, once the operator sends the "return-to-dig" operator interface actuation signal 48 to actuator 15 at stage 63 of FIG. 3, the controller 15 receives data from the angle sensor 24 at stage 71 (FIG. 4) and uses the angle sensor data to determine the current inclination of implement 25 at stage 72. The current inclination is compared to the stored target inclination at a stage 73. If the current inclination is not equal to the desired inclination, controller 15 generates an implement command signal 49 in order to move coupler 22, and thus implement 25, towards the target inclination signal. The implement command signal 49 may be based upon a data map contained within the controller 15 that may be a function of the difference between the current angle of inclination and the stored target inclination angle. Once the implement command signal 49 is generated, controller 15 transmits the implement command signal at stage 75 to the coupler actuation system 23 in order to move the coupler 22 and implement 25 in the desired direction. After transmitting the implement command signal 49 at stage 75, controller 15 continues to receive angle sensor data at stage 71 in order to properly position coupler 22 and implement 25.

If the current inclination as determined by controller 15 at stage 72 is equal to the desired target inclination at stage 73, controller 15 determines whether lift arm 21 has reached its base position at stage 76. Once lift arm 21 has reached its base position, it will no longer be rotating or moving downward and thus no longer affecting the inclination of implement 25. As such, if lift arm 21 and implement 25 are at their base positions, the automated control of the lift arm and implement may be terminated. If the lift arm 21 has not reached its base position, further movement of lift arm 21 will change the angle of inclination of implement 25 and thus automated adjustment of the angle of inclination of coupler 22 and implement 25 is continued at stage 71 until the current angle of inclination equals the desired target angle of inclination and the lift arm 21 has reached its base position. An operator may cancel the "return-to-dig" process once it has begun by operating the operator interface 13 or another operator control in a predetermined manner.

If desired, system 26 may be used to provide the functionality of automatically returning implement 25 to a desired target angle of inclination without also moving lift arm 21 to its base position. In such an operation, an operator generates a target signal indicative of the desired angle of inclination of the implement in a manner similar to that of stage 61 of FIG. 3 but without moving the implement to the base position. For example, the operator may move the implement to the desired inclination and move an operator interface in a predetermined manner. The movement of the operator interface may cause the target inclination signal to be stored within controller 15 in a manner similar to stage 62. Once the operator provides an appropriate operator interface actuation signal in a manner similar to stage 63, system 26 operates in a manner similar to that set forth in flowchart 70 of FIG. 4 except that monitoring of the position of arm 21 at stage 76 is omitted.

INDUSTRIAL APPLICABILITY

The industrial applicability of the system described herein will be readily appreciated from the foregoing discussion. The present disclosure is applicable to many machines and many tasks accomplished by machines. One exemplary machine for which the system is suited is a wheeled loader. However, the system may be applicable to any type of loader and any type of machine that would benefit from automated movement of a lift arm and an associated implement to a pre-selected position such as a "return-to-dig" position.

The disclosed system operates to stores a signal indicative of a desired inclination of an implement. During the course of operating the loader, an operator may want to move the lift arm and implement to a base position defined by the lift arm being positioned near its lower limit of travel and the implement being positioned at its stored inclination. Upon the operator actuating a designated operator interface, the controller of the system generates and transmits an implement command signal to an electro-hydraulic system to move the implement to the stored inclination. The controller further generates and transmits a lift arm command signal to the electro-hydraulic system to move a lift arm towards a lower limit of travel of the lift arm. After the controller receives a signal indicating that a sensor on the lift arm is adjacent a sensor trigger on the loader near the lower limit of travel of the lift arm, the controller terminates the lift arm command signal and movement of the lift arm may be terminated. If desired, the controller may transmit a second lift arm command signal to the electro-hydraulic system to further move the lift arm.

In addition, system may operate in a similar manner but without moving the lift arm to a position near its lower limit of travel. This functionality may be desirable when loading the implement at a first inclination and unloading it at a second orientation without moving the lift arm 21.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A system for automated movement of a lift arm and an implement of a loader from a remote position to a base position near a lower limit of travel of the lift arm, the system comprising:

a sensor mounted on one location of the lift arm and the loader;

a sensor trigger mounted on another location of the lift arm and the loader; and a controller configured to:

store a signal indicative of a desired inclination of the implement, the desired inclination being a component of the base position;

receive a signal indicative of actuation of an operator interface on the loader, the operator interface actuation signal indicating a desired movement of the lift arm and the implement to the base position; and responsive to receiving the operator interface actuation signal:

transmit an implement command signal to an electro-hydraulic system to move the implement to the desired inclination;

transmit a lift arm command signal to the electro-hydraulic system to move the lift arm towards the lower limit of travel of the lift arm;

receive a signal indicative of activation of the sensor mounted on one location of the lift arm and the loader based upon movement of the sensor near the sensor trigger mounted on another location of the lift arm and the loader at a position near the lower limit of travel of the lift arm; and terminate the lift arm command signal based upon receipt of the sensor activation signal.

2. The system of claim 1, wherein the controller is further configured to transmit a second lift arm command signal to the electro-hydraulic system to control the movement of the lift arm near the lower limit of travel of the lift arm after termination of the lift arm command signal.

3. The system of claim 2, wherein the controller is further configured such that transmission of the implement command signal occurs generally simultaneously with the transmission of at least one of the lift arm command signal and the second lift arm command signal.

4. The system of claim 2, wherein the controller is further configured such that the second lift arm command signal includes both a magnitude and a duration for directing movement of the lift arm near the lower limit of travel of the lift arm.

5. The system of claim 1, wherein the controller is further configured such that the automated movement of the lift arm and implement is cancelled upon receipt of a second, predetermined operator interface actuation signal after receipt of the operator interface actuation signal.

6. The system of claim 1, wherein the controller is further configured to store as the desired inclination signal a single signal generated by an inclination sensor that measures inclination of the implement relative to an earth reference.

7. A loader, comprising:

a movable lift arm;

an implement movably coupled to the lift arm;

an operator interface;

an inclination sensor configured to sense inclination of the implement;

a sensor mounted on one location of the lift arm and the loader;

at least one sensor trigger for activating the sensor, the sensor trigger defining a trigger position near a lower limit of travel of the lift arm, the sensor trigger being mounted on another location of the lift arm and the loader; and a controller configured to:

store a signal from the inclination sensor indicative of a desired inclination of the implement;

receive a signal indicative of actuation of the operator interface, the operator interface actuation signal indicating a desired movement of the lift arm and the implement to a base position, the base position including the lift arm being positioned near the lower limit of travel and the implement being positioned at the desired inclination; and responsive to receiving the operator interface actuation signal:

transmit an implement command signal to an electro-hydraulic system to move the implement to the desired inclination;

transmit a lift arm command signal to the electro-hydraulic system to move the lift arm towards the lower limit of travel of the lift arm;

receive a signal indicative of activation of the sensor based upon movement of the sensor near the sensor trigger at the trigger position near the lower limit of travel of the lift arm; and terminate the lift arm command signal based upon receipt of the sensor activation signal.

8. The loader of claim 7, wherein the controller is further configured to transmit a second lift arm command signal to the electro-hydraulic system to control the movement of the lift arm near the lower limit of travel of the lift arm after termination of the lift arm command signal.

9. The loader of claim 8, wherein the controller is further configured such that transmission of the implement command signal occurs generally simultaneously with the transmission of at least one of the lift arm command signal and the second lift arm command signal.

10. The loader of claim 8, wherein the controller is further configured such that the second lift arm command signal includes both a magnitude and a duration for directing movement of the lift arm near the lower limit of travel of the lift arm.

11. The loader of claim 7, wherein movement of both of the lift arm and the implement is cancelled upon receipt of a second, predetermined operator interface actuation signal after receipt of the operator interface actuation signal.

12. The loader of claim 7, wherein the sensor is a switch providing binary signals to the controller.

13. The loader of claim 12, wherein the switch is a proximity sensor.

14. The loader of claim 7, wherein the controller is further configured such that the lift arm command signal includes a magnitude for directing movement of the lift arm for a sufficient time so that the sensor mounted on the one location of the lift arm and the loader moves near the sensor trigger.

15. The loader of claim 7, wherein the inclination sensor is mounted on a coupler coupling the lift arm and the implement.

16. A controller-implemented method for automated movement of a lift arm and an implement of a loader to a base position adjacent a lower limit of travel of the lift arm, the method comprising:

storing a signal within a controller indicative of a desired inclination of the implement, the desired inclination being a component of the base position;

receiving a signal at the controller indicative of actuation of an operator interface on the loader, the operator interface actuation signal indicating a desired movement of the lift arm and implement to the base position; and upon receiving the operator interface actuation signal:

transmitting an implement command signal from the controller to an electro-hydraulic system to move the implement to the desired inclination;

transmitting a lift arm command signal from the controller to the electro-hydraulic system to move the lift arm downward towards the lower limit of travel of the lift arm;

receiving a signal at the controller indicative of activation of a sensor mounted on one location of the lift arm and the loader based upon movement of the sensor near a sensor trigger mounted on another location of the lift arm and the loader at a position near the lower limit of travel of the lift arm; and terminating the lift arm command signal based upon receipt of the sensor activation signal at the controller.

17. The method of claim 16, further including the step of transmitting a second lift arm command signal from the controller to the electro-hydraulic system to control the movement of the lift arm near the lower limit of travel of the lift arm after termination of the lift arm command signal.

18. The method of claim 17, wherein the step of transmitting the implement command signal occurs generally simultaneously with transmitting at least one of the lift arm command signal and the second lift arm command signal.

19. The method of claim 17, wherein the step of transmitting the second lift arm command signal includes transmitting both a magnitude and a duration for directing movement of the lift arm near the lower limit of travel of the lift arm.

20. The method of claim 16, further including the step of cancelling the movement of the lift arm and implement upon receipt of a second, predetermined operator interface actuation signal at the controller after receipt of the operator interface actuation signal.

* * * * *